US010800621B2

(12) United States Patent
Sendo

(10) Patent No.: US 10,800,621 B2
(45) Date of Patent: Oct. 13, 2020

(54) SHEET FEEDING APPARATUS AND IMAGE FORMING APPARATUS

(71) Applicant: KONICA MINOLTA, INC., Chiyoda-ku, Tokyo (JP)

(72) Inventor: Hiroshi Sendo, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/242,453

(22) Filed: Jan. 8, 2019

(65) Prior Publication Data

US 2019/0218048 A1 Jul. 18, 2019

(30) Foreign Application Priority Data

Jan. 9, 2018 (JP) ..... 2018-000938
Jan. 9, 2018 (JP) ..... 2018-000939

(51) Int. Cl.

| | |
|---|---|
| ***B65H 3/14*** | (2006.01) |
| ***B65H 3/54*** | (2006.01) |
| ***B65H 3/48*** | (2006.01) |
| ***B65H 3/12*** | (2006.01) |
| ***B65H 7/00*** | (2006.01) |

(52) U.S. Cl.

CPC ..... *B65H 3/14* (2013.01); *B65H 3/128* (2013.01); *B65H 3/48* (2013.01); *B65H 3/54* (2013.01); *B65H 7/00* (2013.01); *B65H 2405/15* (2013.01); *B65H 2511/11* (2013.01); *B65H 2511/416* (2013.01); *B65H 2513/50* (2013.01); *B65H 2801/06* (2013.01)

(58) Field of Classification Search

CPC . B65H 3/128; B65H 3/14; B65H 3/48; B65H 3/54; B65H 7/00

USPC ..... 271/97, 98

See application file for complete search history.

(56) References Cited

U.S. PATENT DOCUMENTS 5,893,554 A * 4/1999 Okahashi ..... B65H 3/128 271/104
2016/0107854 A1* 4/2016 Hashimoto ..... B65H 7/02 271/11

FOREIGN PATENT DOCUMENTS

JP 2012046278 A 3/2012
JP 2016117589 A 6/2016

* cited by examiner

*Primary Examiner* — David H Bollinger
(74) *Attorney, Agent, or Firm* — Cantor Colburn LLP

(57) ABSTRACT

A sheet feeding apparatus includes a sheet loader, a rear end holder, an air blower, a front end holder, a sender and an air controller. The sheet loader stores stacked sheets. The rear end holder holds a rear end of a topmost sheet on the sheet loader. The air blower blows air to the loaded sheets to raise a sheet. The front end holder holds a front end of the raised topmost sheet. The sender sends the sheet in the sheet feeding direction. The air controller controls the air blower to start blowing a raising air to raise the sheet after the rear end holder holds the rear end of a next sheet that is stacked under the topmost sheet before a rear end of the topmost sheet sent in the sheet feeding direction by the sender passes through the front end holder.

19 Claims, 12 Drawing Sheets

BELTS
ON
OFF
FRONT END AIR BLOWER
DOWNWARD
UPWARD
SIDE END AIR BLOWER
ON
OFF
t1
t2
t3
t6, t7
t8
T1
T2
T3

BELTS
ON
OFF
FRONT END AIR BLOWER
DOWNWARD
UPWARD
SIDE END AIR BLOWER
ON
OFF
REAR END HOLDER
HOLD (MOVING UP)
FREE (MOVING DOWN)
t1
t2
t3
t4
t5
t6
t7
t8
T1
T2
T3

BELTS
ON
OFF
FRONT END AIR BLOWER
DOWNWARD
UPWARD
SIDE END AIR BLOWER
ON
OFF
t1
t2
t3
t6, t7
t8
T1
T2
T3

BELTS
ON
OFF
FRONT END AIR BLOWER
DOWNWARD
UPWARD
SIDE END AIR BLOWER
ON
OFF
REAR END HOLDER
HOLD (MOVING UP)
FREE (MOVING DOWN)
t1
t2
t3
t4
t5
t6
t7
t8
T1
T2
T3

SHEET FEEDING APPARATUS AND IMAGE FORMING APPARATUS

CROSS-REFERENCE TO RELATED APPLICATION

The present application claims priority under 35 U.S.C. § 119 to Japanese Patent Application No. 2018-000939 and Japanese Patent Application No. 2018-000938, both filed on Jan. 9, 2018, the entirety of both of which are hereby incorporated by reference herein and forms a part of the specification.

BACKGROUND

1. Field of the Invention

The present invention relates to a sheet feeding apparatus and an image forming apparatus.

2. Description of the Related Art

In image forming apparatuses that form an image on a sheet, air-suctioning sheet feeding apparatuses have been known in the art which store stacked sheets and feed them to an image formation unit (see JP 2016-117589A).

Such an air-suctioning sheet feeding apparatus includes:

a side end air blower that blows air to an upper sheet of stacked sheets on a sheet loader from the both sides (side ends) in the direction perpendicular to the sheet conveyance direction so as to raise the upper sheet;

a front end air blower that blows air to the topmost sheet from the front end thereof so as to raise the upper sheet and to separate the topmost sheet from the other sheets; and a vacuum conveyer that holds and conveys a sheet in the conveyance direction with a conveyance belt disposed above the sheet stack.

This mechanism can send sheets one by one to a sheet conveyance path by holding only the topmost sheet and reliably separating it from the other sheets.

However, this sheet feeding apparatus only holds the topmost sheet and does not fix the other sheets below the topmost sheet while sending the topmost sheet. In this condition, since the second and other sheets may sometimes stick to the topmost sheet to cause double feeding, it is necessary not to raise and feed the next sheet until the topmost sheet has passed through the suction conveyer. This prevents an improvement of the productivity.

In this regard, JP 2012-046278A discloses providing a presser between a rear end regulator plate and a vacuum conveyer to press a sheet. When a sheet is moved in the direction opposite to the sheet feeding direction by separating air, the presser regulates the movement of the sheet in the direction opposite to the sheet feeding direction. That is, the presser fixes the sheet to prevent the second and other sheets from moving in the opposite direction.

In air-suctioning sheet feeding apparatuses, when a sheet is long in the sheet feeding direction, e.g. a long sheet, it is necessary that the separating air reaches the rear end of the sheet in order to completely separate the sheet from the other sheets thereunder. Too weak separating air results in insufficient separation of sheets, and the contact between the sheets increases the risk of double feeding. In contrast, too strong separating air may move a sheet backward or cause bucking of a sheet.

To cope with the problems, JP 2012-046278A discloses providing a presser that is disposed above the midway between the rear end regulator plate for regulating the rear end position of a sheet and the vacuum conveyer. When the sheet is moved in the direction opposite to the sheet feeding direction by the separating air, the presser regulates movement of a sheet in the direction opposite to the sheet feeding direction. This configuration can solve the above-described problem that occurs when the separating air is too strong.

However, pressing a sheet from above as in the method of JP 2012-046278A increases the friction between the topmost sheet and the other sheets thereunder and eventually increases the risk of double feeding.

SUMMARY

The present invention has been made in view of the above-described problems, and an object thereof is to provide a sheet feeding apparatus and an image forming apparatus that can reliably separate sheets to reduce the occurrence of double feeding.

To achieve at least one of the abovementioned objects, according to an aspect of the present invention, a sheet feeding apparatus includes:

a sheet loader which stores stacked sheets;

a rear end holder which holds a rear end in a sheet feeding direction of a topmost sheet on the sheet loader;

an air blower which blows air to the loaded sheets to raise a sheet;

a front end holder which holds a front end of the raised topmost sheet;

a sender which sends the sheet in the sheet feeding direction; and an air controller which controls blow of the air from the air blower, wherein the air controller controls the air blower to start blowing a raising air to raise the sheet after the rear end holder holds the rear end of a next sheet that is stacked under the topmost sheet before a rear end of the topmost sheet sent in the sheet feeding direction by the sender passes through the front end holder.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

First Embodiment

Hereinafter, a first embodiment of the present invention will be described with the drawings. While a variety of limitations that are favorable for carrying out the present invention are included in the following first embodiment, the scope of the present invention is not limited to the following embodiment and illustrated examples.

Summary of Image Forming Apparatus

Figure 1:
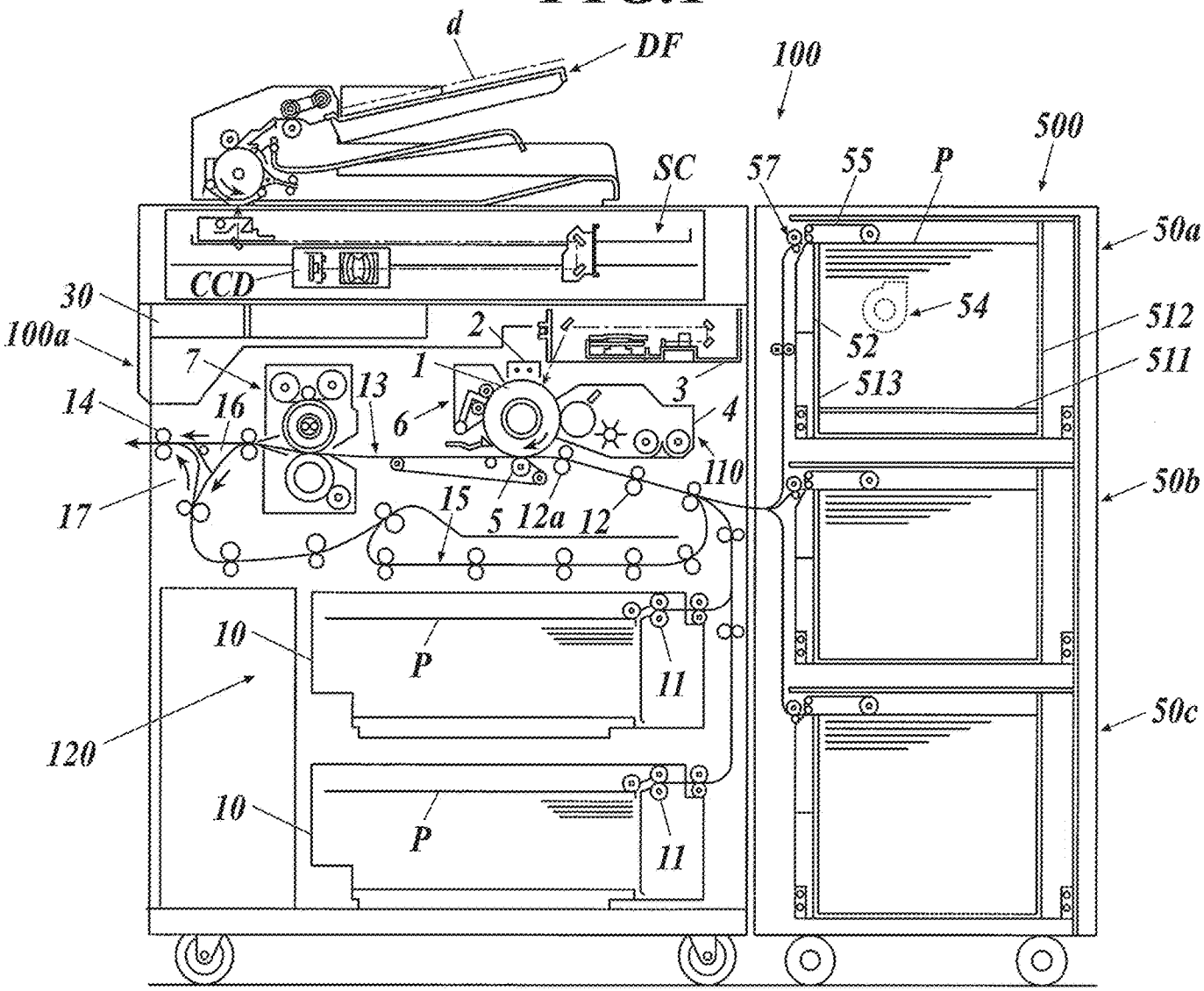
FIG. 1 is an overall configuration view of an image forming apparatus according to the present invention.
Figure 2:
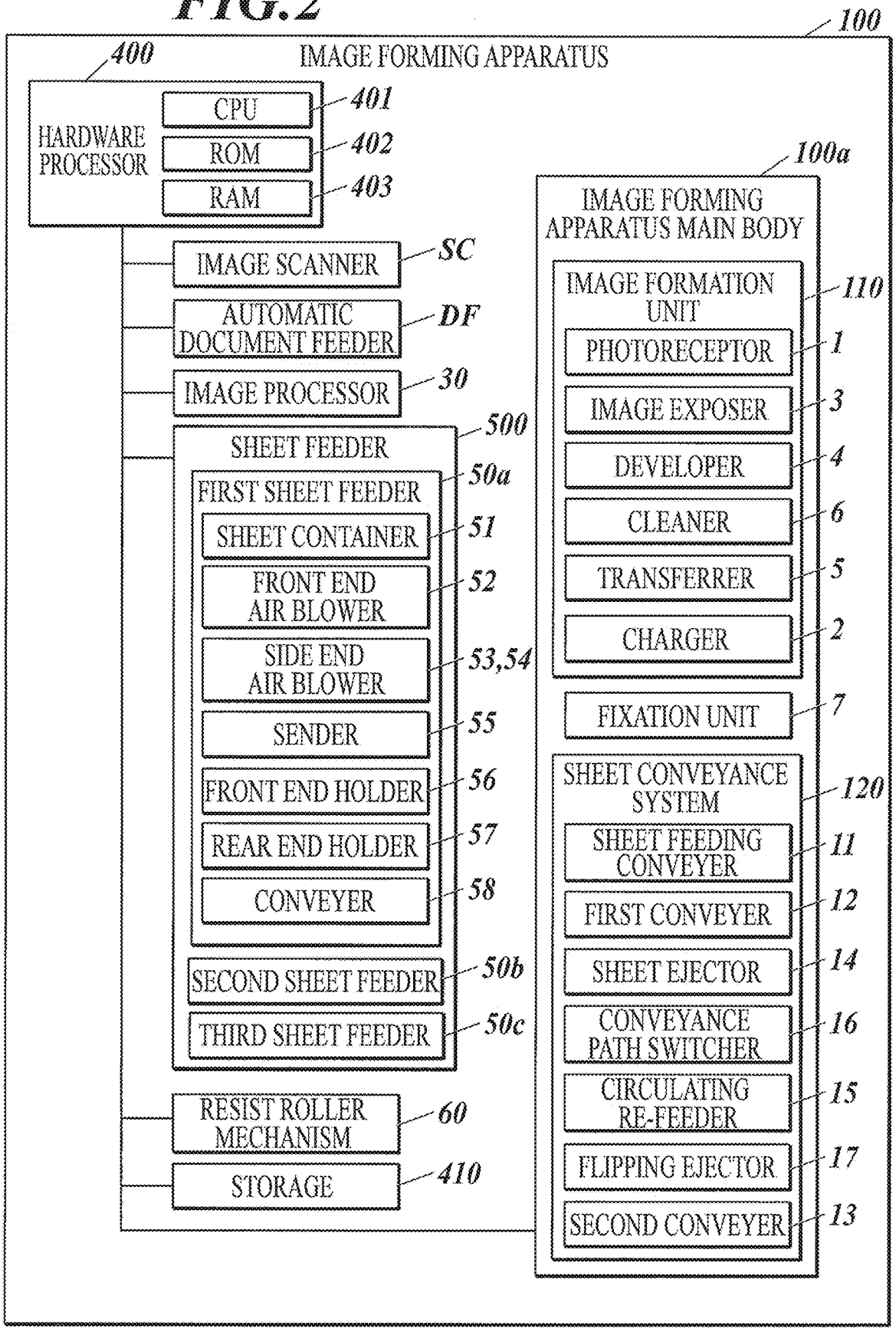
FIG. 2 is a block diagram of a control system of the image forming apparatus according to the present invention.

FIG. 1 is an overall configuration view of an image forming apparatus 100 according to the present invention, and FIG. 2 is a block diagram of the functional configuration of the image forming apparatus 100.

As illustrated in FIG. 1 and FIG. 2, the image forming apparatus 100 mainly includes an image forming apparatus main body 100*a*, an image scanner SC, an automatic document feeder DF, an image processor 30, a sheet feeder 500 and a hardware processor 400. The hardware processor 400 and the sheet feeder 500 constitute a sheet feeding apparatus.

The image forming apparatus main body 100*a* includes an image formation unit 110, a fixation unit 7 and a sheet conveyance system 120. The image formation unit 110 includes a photoreceptor 1, a charger 2, image exposer 3, a developer 4, a transferrer 5, a cleaner 6 and the like.

The sheet conveyance system 120 includes two-tired sheet feeding cassettes 10, 10 that store sheets, sheet feeding conveyers 11, 11 that feed sheets from the respective sheet feeding cassettes 10 one by one, a first conveyer 12 that conveys a sheet from the sheet feeding conveyers 11, 11 to a point just before the image formation unit 110, a second conveyer 13 that conveys a sheet from the first conveyer 12 to the downstream of the fixation unit 7, a sheet ejector 14 that conveys a sheet to an ejection tray (not shown), a circulating re-feeder 15 that branches off from the second conveyer 13 and rejoins to the first conveyer 12, a conveyance path switcher 16 that switches the conveyance path between the sheet ejector 14 and the circulating re-feeder 15, and a flipping sheet ejector 17 that branches off from the circulating re-feeder 15 to flip a sheet.

The sheet feeder 500 includes a first sheet feeder 50*a*, a second sheet feeder 50*b* and a third sheet feeder 50*c* that are vertically aligned.

Automatic Document Feeder and Image Scanner

The automatic document feeder DF conveys an original d mounted on a platen to the image scanner SC. The image scanner SC reads an image on either or both sides of the conveyed original d with an image sensor CCD. The image processor 30 performs analog processing, A/D conversion, shading correction, image compression and the like on an analog signal that is obtained by photoelectric conversion of the image sensor CCD. The image processor 30 sends the image signal thus obtained to the image exposer 3.

The hardware processor 400, which can communicate with an external device (e.g. personal computer) connected to a communicator (not shown) through a communication network, may also send an image signal received from the external device to the image exposer 3 via the image processor 30.

Image Formation Unit

In the image formation unit 110, the charger 2 charges the photoreceptor 1, the image exposer 3 irradiates the photoreceptor 1 with a laser beam to form an electrostatic latent image, and the developer 4 develops the electrostatic latent image to form a toner image.

While being conveyed, a sheet P fed from the sheet feeding cassettes 10 by the sheet feeding conveyers 11 is synchronized with a toner image by a resist roller 12*a* of the first conveyer 12. The transferrer 5 then transfers the toner image to the sheet P, and the fixation unit 7 fixes the toner image.

In addition to the sheets P stored in the sheet feeding cassettes 10, a sheet P stored in the sheet feeder 500 is also fed to the image forming apparatus main body 100*a* where a toner image is transferred to the sheet P.

The second conveyer 13 ejects the sheet P with the fixed image out of the apparatus. The cleaner 6 removes untransferred residual toner on the photoreceptor 1. In double-sided printing, the conveyance path switcher 16 sends the sheet P with the image on the first side to the circulating re-feeder 15 where the sheet P is flipped. The image formation unit 110 forms an image on the second side, and thereafter the second conveyer 13 ejects the sheet P. In flipping ejection, the sheet P is deviated from a normal ejecting path and switches back at the flipping sheet ejector 17. The second conveyer 13 ejects the sheet P thus flipped out of the apparatus.

Summary of Sheet Feeding Apparatus

Figure 3:
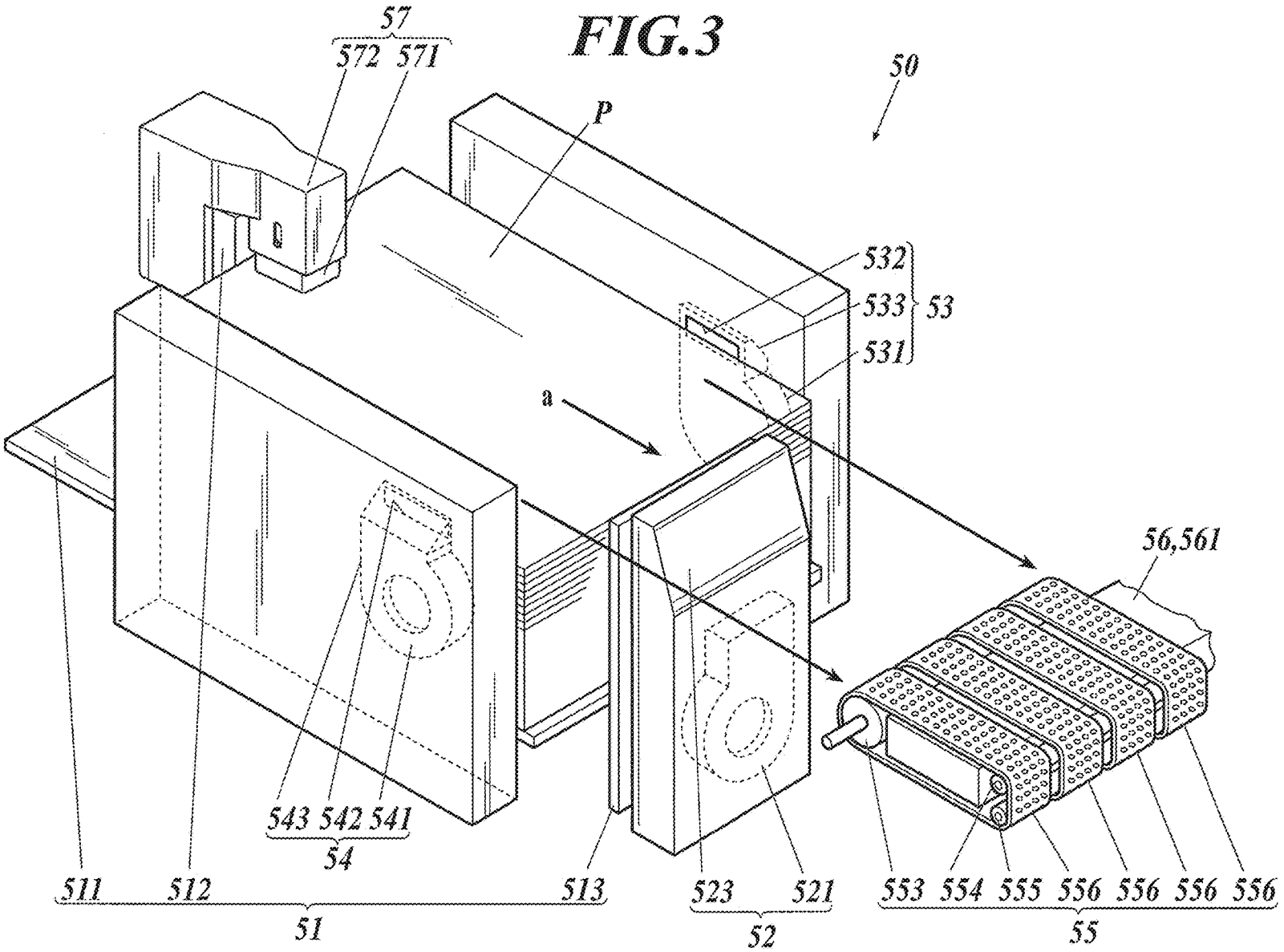
FIG. 3 is a perspective view of a sheet feeder of the image forming apparatus.

FIG. 3 is a schematic perspective view of the first sheet feeder 50*a* of the sheet feeder 500. For example, the first sheet feeder 50*a*, the second sheet feeder 50*b* and the third sheet feeder 50*c*, which are vertically aligned in the sheet feeder 500 as described above, have the same configuration, and only the first sheet feeder 50*a* will be described here.

The first sheet feeder 50*a* includes a sheet container 51, a front end air blower 52, side end air blowers 53, 54, a sender 55, a front end holder 56, a rear end holder 57, a conveyer 58 and the like.

Configuration of Sheet Container and Surroundings Thereof

The sheet container 51 includes a sheet loading pallet 511 as a horizontal sheet loader in which stacked sheets P are loaded, a rear end regulating member 512 that is disposed behind the sheet loading pallet 511, i.e. at the upstream side in the sheet feeding direction a, and a front end regulating member 513 that is disposed in front of the sheet loading pallet 511, i.e. at the downstream side in the sheet feeding direction a.

In the following description of the sheet feeder 50, the left hand direction with respect to the sheet feeding direction a, which is a horizontal direction perpendicular to the sheet feeding direction a, is referred to as "left", and the right hand direction with respect to the sheet feeding direction a, which is a horizontal direction perpendicular to the sheet feeding direction a, is referred to as "right".

The sheet loading pallet 511 is supported in the sheet feeder 50 in a vertically movable manner.

The upper end of the front end regulating member 513 is slightly lower than the upper end of the rear end regulating member 512. The sheet loading pallet 511 moves up and down by an actuator (not shown), and the hardware processor 400 controls the actuator so that the top of the stacked sheets P on the sheet loading pallet 511 is always at a specific level that is slightly lower than the upper end of the front end regulating member 513. This level control using the actuator is based on the level of the topmost sheet P that is detected by a sensor (not shown) disposed at the rear end regulating member 512.

When sheets P are not fed, e.g. when a user fills the sheet feeder with sheets P, the sheet loading pallet 511 may be in a lower position.

The rear end regulating member 512 moves up and down by an actuator (not shown). As described later, the rear end regulating member 512 moves in the height direction along with the rear end holder 57. When sheets P are not fed, e.g. when a user fills the sheet feeder with sheets P, the rear end regulating member 512 may be in a higher position while the sheet loading pallet 511 may be in a lower position.

The rear end regulating member 512 is movable also in the sheet feeding direction a by an actuator (not shown) according to the length in the sheet feeding direction of sheets P.

Front End Air Blower and Side End Air Blower

The front end air blower 52 is disposed adjacent to the front end regulating member 513 at the downstream in the sheet feeding direction a of the front end regulating member 513. Further, the side end air blowers 53, 54 are disposed respectively at the right and left sides of the sheet loading pallet 511. The side end air blowers 53, 54 include flat and vertical inner side walls that function as regulating members for regulating the lateral position of sheets.

The front end air blower 52 and the side end air blowers 53, 54, in which air blowing fans 521, 531, 541 are respectively provided, are configured to blow air through air outlets 522 (see FIG. 4), 532, 542. The front end air blower 52 and the side end air blowers 53, 54 function as air blowers.

Figure 4:
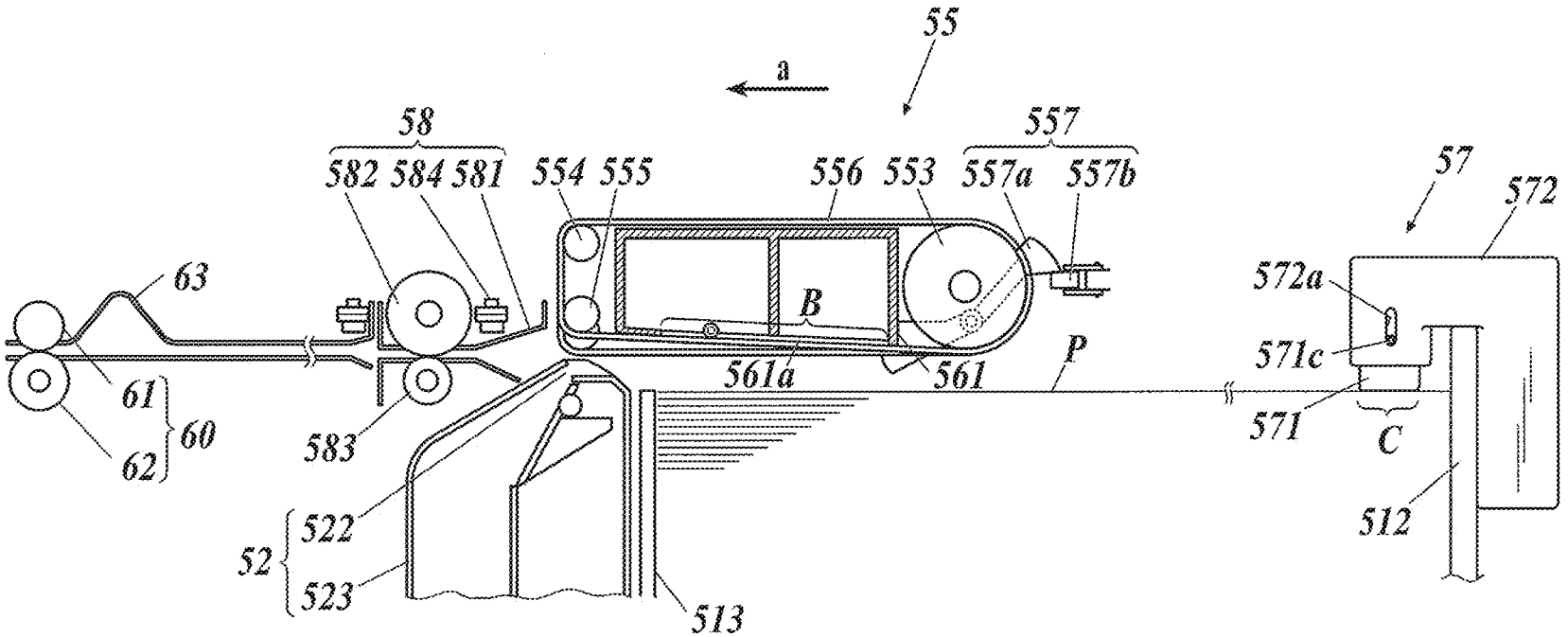
FIG. 4 is a partially cross-sectional side view of the sheet feeder.

FIG. 4 is a cross-sectional view illustrating the structure around the front end in the sheet feeding direction a of the topmost sheet P on the sheet loading pallet 511.

The front end air blower 52 includes a nozzle 523 for blowing air through the air outlet 522 in a direction slightly inclined upward with respect to the direction opposite to the sheet feeding direction a. The front end air blower 52 includes a switching valve (not shown) in the nozzle 523 that allows switching the blow direction between upward blow and downward blow. In the downward blow, air is blown to the edges of the stacked sheets P, which is effective to raise a sheet P. In the upward blow, air is blown to the front end of the raised sheet P, which is effective to separate the topmost sheet P from other sheets that are raised along with the topmost sheet P, i.e. to puff up the sheets.

As illustrated in FIG. 3, the side end air blowers 53, 54 include nozzles 533, 543 for blowing air from the left and right sides of the topmost sheet P at the specified level toward the sheet P in the horizontal direction or a direction slightly inclined upward from the horizontal direction. The air outlets 532, 542 of the nozzles 533, 543 are formed such that the upper edges are higher than the topmost sheet P disposed at the specified height while the lower edges are lower than the topmost sheet P. When air is blown through the air outlets 532, 542 of the side end air blowers 53, 54, this configuration allows blowing air to the top sheet P of the stacked sheets to raise the top sheet P.

The downward blow of the front end air blower 52 and the blow of the side end air blowers 53, 54 serve as raising air for raising a stacked sheet P. The raising air may be constituted by only one of the downward blow of the front end air blower 52 and the air blow of the side end air blowers 53, 54.

The upward blow by the front end air blower 52 serve as separating air for separating the raised topmost sheet P from the other sheets raised along with the topmost sheet P.

Sender and Holder

Figure 5:
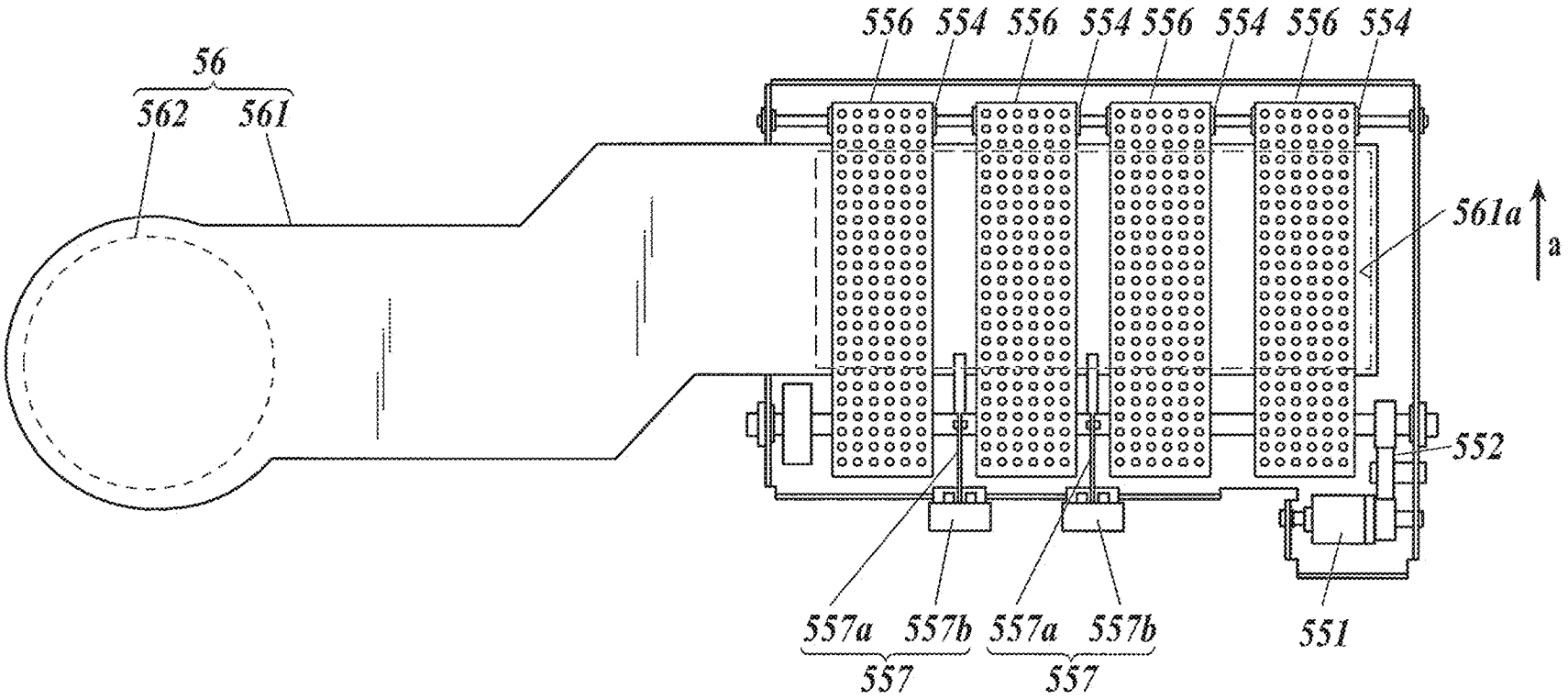
FIG. 5 is a plan view of a sender and a front end holder of the sheet feeder.

FIG. 5 is a plan view of the sender 55 and the front end holder 56. As illustrated in FIG. 3 to FIG. 5, the sender 55 is disposed above the sheet loading pallet 511. In FIG. 3, the sender 55 is illustrated in a deviated position as illustrated by the arrows so that the other surrounding components are shown in the figure. However, the actual sender 55 is disposed above the downstream end in the sheet feeding direction a of the sheet loading pallet 511 as illustrated in FIG. 4.

The sender 55 includes four belt mechanisms aligned in the horizontal direction perpendicular to the sheet feeding direction a, a motor 551 as a sheet feeding driver for driving the belt mechanisms and a transmission gear train 552 intervened between the belt mechanisms and the motor 551.

Each of the belt mechanisms includes a large-diameter roller 553 disposed at the upstream in the sheet feeding direction a, two small-diameter rollers 554, 555 disposed at the downstream in the sheet feeding direction a and a belt 556 disposed around the rollers 553, 554, 555. The motor 551 applies a torque to the large-diameter rollers 553 of the belt mechanisms in the direction of moving the lower side of the belts 556 in the sheet feeding direction a. Instead of the rollers 553, 554, 555, sprockets may be used.

The belts 556 have small through holes over the entire surface, and the front end holder 56 (described later) can provide a vacuum though the small holes to hold a sheet P on the lower side of the belts 556.

At the upstream in the sheet feeding direction a of the belt mechanisms, hold detectors 557 are provided to detect attachment of a sheet on the belts 556. Each of the hold detectors 557 includes a detector body 557*a* and an optical sensor 557*b*. The detector body 557*a* has an approximately bar shape and is supported in such a manner that it can swing.

One end of the detector body 557*a* protrudes downward from the bottoms of the belts 556. When a sheet P is held on the belts 556, the detector body 557*a* is swung so that one end thereof is pushed back in the upward direction. The detector body 557*a* is configured such that when one end is pushed back, the other end moves downward accordingly to interrupt the sensor 557*b*. The sensor 557*b* inputs the resultant change in the amount of received light to the hardware processor 400 so that the hardware processor 400 recognizes attachment of the sheet P.

As illustrated in FIG. 3 to FIG. 5, the front end holder 56 includes a first duct 561 with one end inserted in the belts 556 of the sender 55 and a first fan 562 that is disposed at the other end of the first duct 561 to create a negative pressure inside the first duct 561.

One end of the first duct 561, which is inserted in the belts 556, is formed in an approximately rectangular box shape with a first opening 561*a* at the bottom. The front end holder 56 can draw air through the first opening 561*a* by creating a negative pressure in the first duct 561 with the first fan 562.

The first opening 561*a* of the first duct 561 is disposed over the lower sides of the four belts 556, and the portions of the belts 556 that are opposed to the first opening 561*a* correspond to a first holding area B where a sheet is held.

Figure 6A:
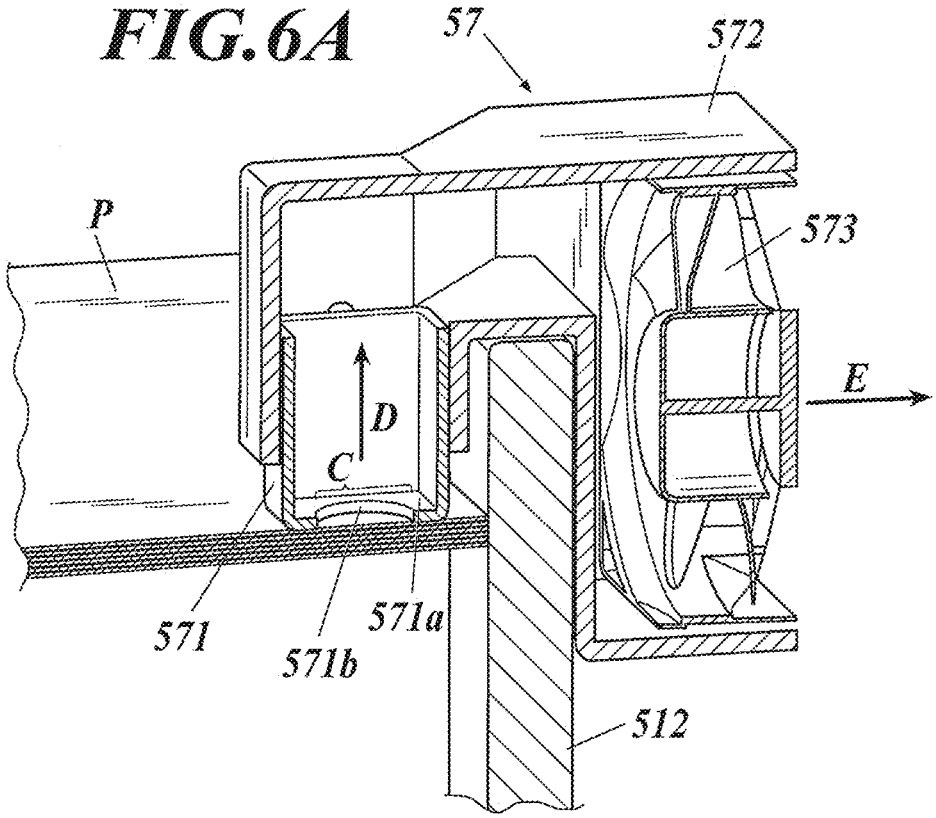
FIG. 6A and FIG. 6B are a partially cross-sectional perspective view of a rear end holder of the sheet feeder.
Figure 6B:
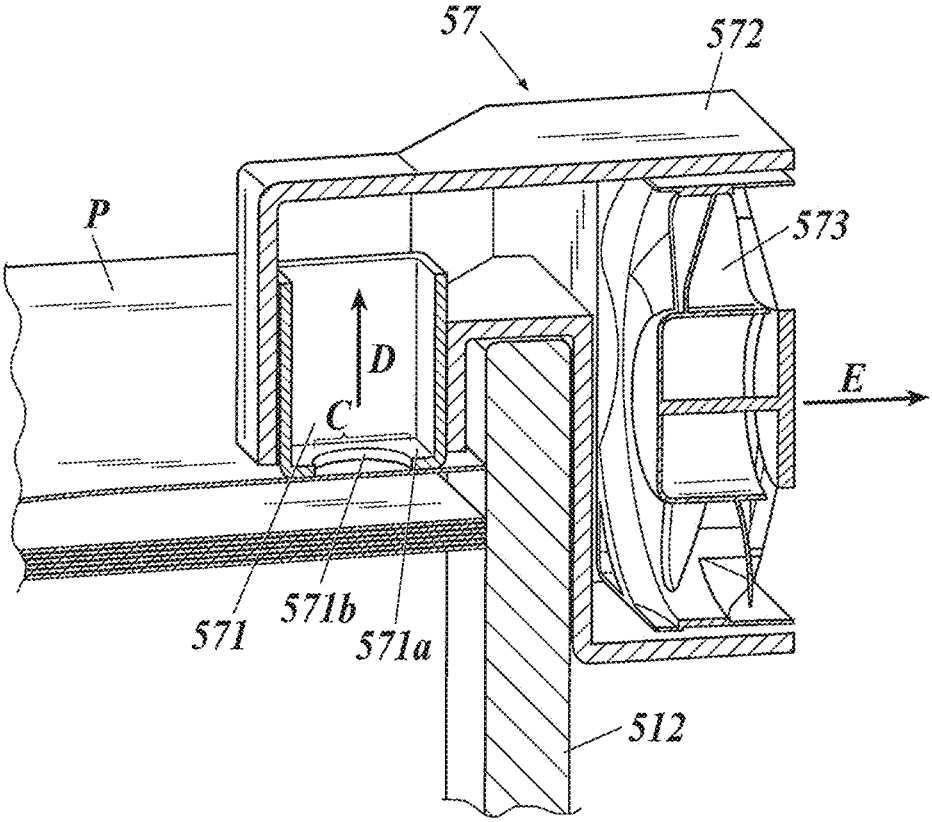

FIG. 6A and FIG. 6B is a partially cross-sectional perspective view of the rear end holder 57. As illustrated in FIG. 6A and FIG. 6B, the rear end holder 57 is fixed at the upper end of the rear end regulating member 512. The rear end holder 57 includes a movable portion 571 that is disposed in contact with the rear end of the topmost sheet P and is movable upward by negative pressure and downward by its own weight, a second duct 572 with one end coupled to the movable portion 571, and a second fan 573 that is disposed at the other end of the second duct 572 to create a negative pressure in the second duct 572.

The movable portion 571 is a bottomed rectangular pipe that has a circular second opening 571*b* at the center of a bottom 571*a* that comes in contact with the topmost sheet P. The second opening 571*b* corresponds to a second holding area C where a sheet is held. When the second fan 573 is turned on, it draws air through the second opening 571*b* in the direction of the arrow D in the figure and discharges the air in the direction of the arrow E in the figure. That is, when a sheet P is held on the second opening 571*b* after the second fan 573 is turned on, a negative pressure is created in the second duct 572.

On a wall of the movable portion 571, one or more pins 571*c* are provided. The pins 571*c* are inserted in a window hole 572*a* of the second duct 572 so that the window hole 572*a* defines the movable range in the height direction. That is, the movable portion 571 is movable between the position as illustrated in FIG. 6A in which the second opening 571*b* is in contact with the topmost sheet P on sheet loading pallet 511 and the position as illustrated in FIG. 6B in which the second opening 571*b* is the furthest away from the stacked sheets on the sheet loading pallet 511.

The operation of the sender 55, the front end holder 56 and the rear end holder 57 in a sheet feeding process will be described.

When the front end air blower 52 and the side end air blower 53, 54 blow the raising air to raise one or more sheets P on the top of the stacked sheets on the sheet loading pallet 511, the sender 55 and the front end holder 56 hold the front end of the raised topmost sheet P on the lower side of the belts 556 by the suction force created at the first holding area B.

Meanwhile, the second opening 571*b* of the movable portion 571 is in contact with the topmost sheet P, and the rear end holder 57 holds the rear end of the sheet P on the movable portion 571 by the suction force created at the second holding area C. When the force by the negative pressure in the second duct 572 surpasses the total weight of the movable portion 571 and the rear end portion of the topmost sheet P, the movable portion 571 moves up to pull up the rear end of the sheet.

In this state, the sender 55 can rotate the belts 556 to send the sheet P in the sheet feeding direction a.

Conveyer

As illustrated in FIG. 4, the conveyer 58 is disposed in proximity to the sender 55 at the downstream in the sheet feeding direction a. The conveyer 58 includes an insertion guide 581 to which a sheet P sent from the lower side of the belts 556 can be inserted, large and small conveyance rollers 582, 583 that are disposed in the middle of the insertion guide 581 to nip and convey the sheet P to the downstream in the sheet feeding direction a, a motor (not shown) as a driver that rotates the conveyance rollers 582, 583, and a sheet detector 584 constituted by an optical or contact sensor that detects arrival of the front end of the sheet P and passage of the rear end of the sheet P at the insertion guide 581.

The insertion guide 581 is widely open in the vertical direction at the end at the upstream in the sheet feeding direction a, and the vertical width is gradually decreased in the sheet feeding direction a. The end at the downstream in the sheet feeding direction a is connected to the conveyance path of the sheet P to the image forming apparatus main body 100*a*.

The large-diameter conveyance roller 582 and the small-diameter conveyance roller 583, which are in contact with each other, is disposed in the insertion guide 581 so that the sheet P that has entered the insertion guide 581 passes through between the large-diameter conveyance roller 582 and the small-diameter conveyance roller 583.

The large-diameter conveyance roller 582 is driven by a motor (not shown) that is controlled by the hardware processor 400. The small-diameter conveyance roller 583, which is in contact with the large-diameter conveyance roller 582, receives a rotational torque in the opposite direction from the large-diameter conveyance roller 583 and rotates accordingly.

The sheet detector 584 is disposed in proximity to the conveyance rollers 582, 583 at the upstream in the sheet feeding direction a. The sheet detector 584 detects whether the sheet P is present at the sheet detector 584 and constantly inputs the detection result to the hardware processor 400. That is, when the detected state of the sheet P changes from the absent to present, the hardware processor 400 recognizes that the front end of the sheet P has reached the sheet detector 584. Similarly, when the detected state of the sheet P changes from present to absent, the hardware processor 400 recognizes that the rear end of the sheet P has passed through the sheet detector 584.

As used herein, the front end of a sheet P refers to the end of the sheet P that is in the downstream in the sheet feeding direction a, and the rear end of a sheet P refers to the end of the sheet P that is in the upstream in the sheet feeding direction a.

Hardware Processor

The hardware processor 400 includes a CPU (Central Processing Unit) 401, a ROM (Read Only Memory) 402, a RAM (Random Access Memory) 403 and the like. The CPU 401 reads a program in the ROM 402 according to processing to be performed, develops it in the RAM 403 and integrally controls the operation of the components (the image scanner SC, the automatic document feeder DF, the image processor 30, the image forming apparatus main body 100*a*, the sheet feeder 500 and the like) of the image forming apparatus 100 in cooperation with the developed program. In this process, the CPU 401 also references a variety of data stored in the storage 410. For example, the storage 410 is constituted by a non-volatile semiconductor memory (so-called flash memory), a hard disk drive or the like.

The hardware processor 400 serves as an air controller and a hold controller.

The hardware processor 400, which also includes a communicator constituted by a communication control card (not shown) such as a LAN card, can send or receive various data to and from an external device (e.g. personal computer) connected through a communication network such as a LAN (local area network) or a WAN (wide area network).

Sheet Feeding Control of Sheet Feeding Apparatus: Puffing Control by Rear End Holder Sheet feeding control of the first sheet feeder 50*a* of the sheet feeder 500 by the hardware processor 400 will be described. The same sheet feeding control is performed on the second sheet feeder 50*b* and the third sheet feeder 50*c*.

First, the relationship between the strength of the raising air and the accuracy of separation of sheets P in the sheet feeding process will be described based on FIG. 7A and FIG. 7B.

When the sheet feeding process is started, the sheet feeder 50 blows the raising air to raise a top sheet P by using the front end air blower 52 and the side end air blowers 53, 54, holds the raised sheet P on the lower side of the belts 556 and sends the sheet P toward the conveyer 58.

Figure 7A:
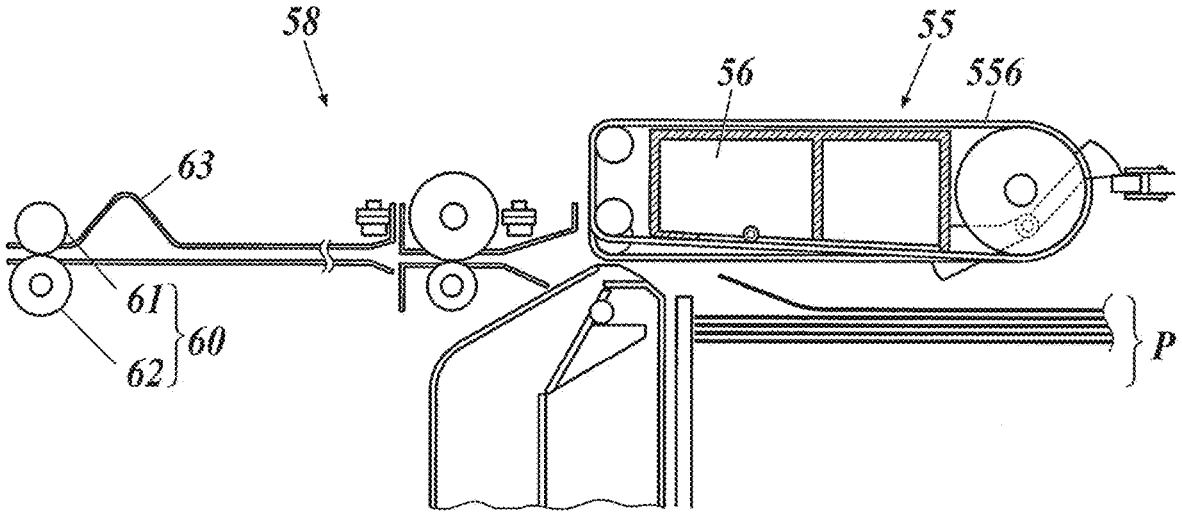
FIG. 7A and FIG. 7B illustrates a raised sheet in a sheet feeder with no rear end holder.
Figure 7B:
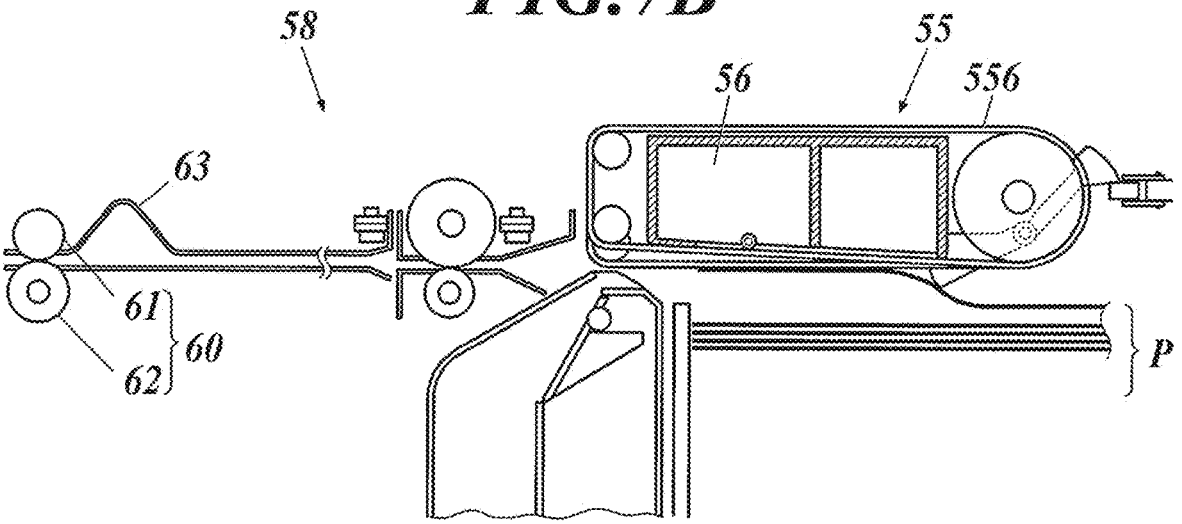

When the strength of the raising air is insufficient, the air does not reach and raise the rear end of the topmost sheet P as illustrated in FIG. 7A, and the topmost sheet P remains in contact with the next sheet. This increases the risk of double feeding When the blow of the raising air is too strong, the topmost P is raised and held on the lower side of the belts 556 as illustrated in FIG. 7B. However, the second and other sheets P may sometimes be buckled.

As described above, it is difficult to control levitation of the rear end of the sheet only by blowing air from the front end air blower 52 and the side end air blowers 53, 54. To assist separation of the rear end, the rear end holder 57 pulls up the rear end of the sheet P.

This process will be described in detail with FIG. 8A through FIG. 8E. In the following description, the topmost sheet and the next sheet thereunder are denoted respectively as P0 and P1.

Figure 8A:
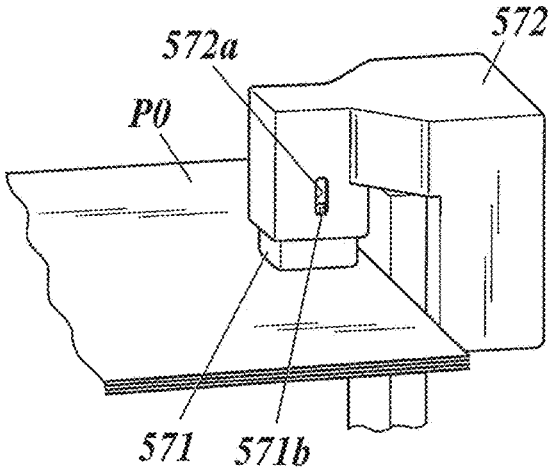
FIG. 8A through FIG. 8E illustrates the rear end holder holding and fixing a sheet.

As illustrated in FIG. 8A, at the start of the sheet feeding process, the movable portion 571 of the rear end holder 57 is in the lower position and in contact with the topmost sheet P0. When the sheet feeding process is started, the second fan 573 is turned on by a control of the hardware processor 400 to create a negative pressure in the second duct 572. Then, air is drawn through the second opening 571*b*, and the movable portion 571 holds the sheet P0.

Figure 8B:
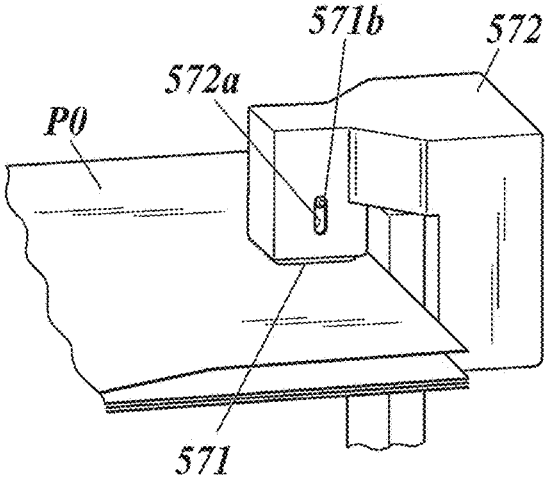

Once the sheet P0 is held, the negative pressure in the second duct 572 is increased as illustrated in FIG. 8B. When the negative pressure surpasses the total weight of the movable portion 571 and the rear end of the topmost sheet P0, the movable portion 571 moves up along with the sheet P0 held thereon so as to pull up the rear end of the topmost sheet P0. As a result, the rear end of the topmost sheet P0 is separated from the rear end of the next sheet P1.

Figure 8C:
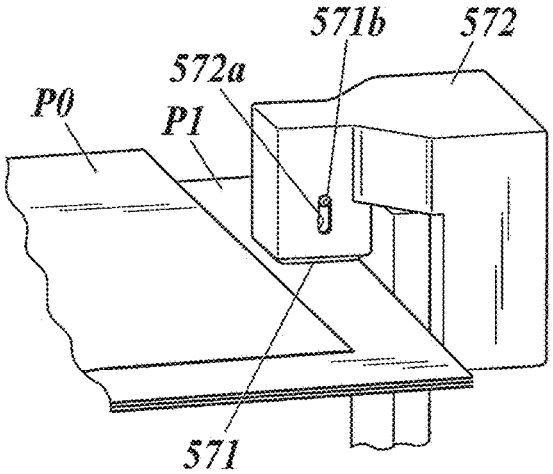

As illustrated in FIG. 8C, when the topmost sheet P0 is conveyed so that the rear end is detached from the movable portion 571, the second opening 571*b* is opened. Once the sheet is released, the pressure in the second duct 572 is increased. The movable portion 571 moves down by its own weight and comes in contact with the upper surface of the rear end of the next sheet P1.

Figure 8D:
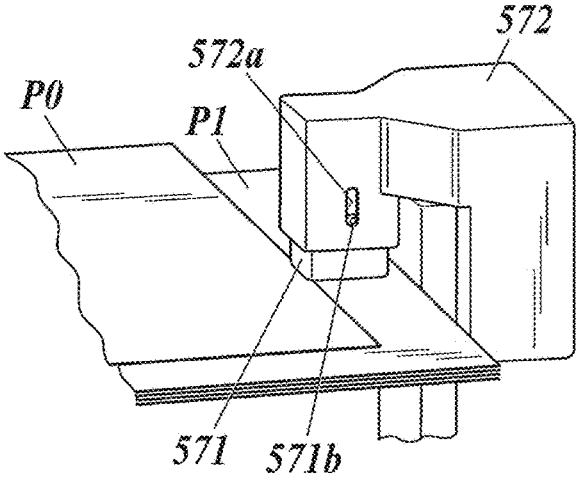

When the movable portion 571 moves down to come in contact with the upper surface of the next sheet P1 as illustrated in FIG. 8D, the movable portion 571 holds the next sheet P1 since air is drawn through the second opening 571*b*. Since the movable portion 571 fixes the next sheet P1, it can prevent the next sheet P1 from being fed along with the topmost sheet P0 to cause double feeding.

Figure 8E:
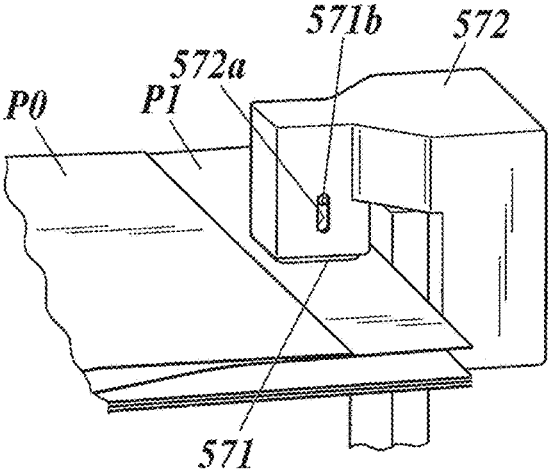

After the movable portion 571 holds the next sheet P1, the negative pressure in the second duct 572 is increased, and the movable portion 571 moves up to pull up the rear end of the next sheet P1 and keep it in the lifted position as illustrated in FIG. 8E while the topmost sheet P0 is being conveyed. That is, puffing of the next sheet P1 is started before the topmost sheet P0 has passed through the conveyer 58. This can reduce the waiting time and increase the production efficiency.

In the embodiment, the hardware processor 400 serves as an air controller to determine the timing of blowing the raising air from the front end air blower 52 and the side end air blowers 53, 54 after the rear end holder 57 holds the sheet P based on at least one of the paper type, the length in the sheet feeding direction, the basis weight and the environment of the loaded sheets P. The ease of separating sheets P differs depending on the paper type. For example, while it is easy to separate sheets P having a rough surface such as recycled paper, it is difficult to separate closely contacted sheets such as coated paper. Further, it is more difficult to separate sheets P as the length in the feeding direction is longer or the basis weight is lighter. In a humid environment in which sheets P absorb moisture to have closer contact between them, it is difficult to separate the sheets P. Accordingly, as the sheets becomes less separable, the hardware processor 400 delays the blow timing to extend the time for the rear end holder 57 to pull up and hold the sheet P so as to improve the separation. By changing the blow timing of the raising air according to the conditions, it is possible to improve the separation.

Further, the hardware processor 400 as the air controller determines whether to blow the raising air from the front end air blower 52 and the side end air blowers 53, 54 and the strength of the raising air based on at least one of the paper type, the length in the sheet feeding direction, the basis weight and the environment of the loaded sheets. For example, the hardware processor 400 may determine not to blow the raising air to highly separable sheets P. This can reduce damage on the sheets as well as unnecessary power consumption The side end air blowers 53, 54 may blow the raising air from the start of the sheet feeding process until the hold detectors 557 detect attachment of the front end of the sheet P. That is, the side end air blowers 53, 54 may stop blowing air after the detection. This can stabilize the flow of the separating air from the front end air blower 52.

Flow of Operation Control of Successive Sheet Feeding in Sheet Feeding Apparatus The flow of an operation control of successive sheet feeding in the sheet feeding apparatus will be described with the flowchart of FIG. 9 and the timing charts of FIG. 10A and FIG. 10B. FIG. 10A is a timing chart of a case in which the rear end holder 57 does not hold a sheet during blow of the raising air, and FIG. 10B is a timing chart of a case in which the rear end holder 57 holds a sheet during blow of the raising air.

The topmost sheet P0, which is the first sheet in the successive sheet feeding process, does not have a precedent sheet that is held on the belts 556. In response to a request to start the sheet feeding process, the hardware processor 400 immediately determines the blow timing and the blow strength of the raising air based on printing conditions (Step 1). As used herein, the printing conditions refer to the paper type, the length in the sheet feeding direction, the basis weight and the environment of sheets P, and the hardware processor 400 makes the determination based on at least one of them. The relationship of the printing conditions to the blow timing and the blow strength of the raising air are stored beforehand in the storage 410 in the form of a table. The printing conditions may be either manually input by a user or determined by the hardware processor 400 that references environment information detected by a humidity sensor and job information.

Subsequently, the hardware processor sets the blow direction of the front end air blower 52 to the downward blow and controls the front end air blower 52 and the side end air blowers 53, 54 to start blowing the raising air. As a result, the topmost sheet P0 on the sheet loading pallet 511 is raised and held on the first holding area B of the belts 556. Further, the hardware processor 400 turns on the second fan 573 of the rear end holder 57. Then, the rear end of the topmost sheet P0 is held on the second holding area C, and when the negative pressure in the second duct 572 surpasses the total weight of the movable portion 571 and the rear end of the topmost sheet P0, the movable portion 571 starts to move up (Step S2, (t1) in FIG. 10A and FIG. 10B).

The hardware processor 400 makes a determination as to whether the status of the hold detectors 557 is "ON", which represents a sheet being detected (Step S3). If it is determined that the status is not "ON" (Step S3, No), the hardware processor 400 repeats the determination in Step S3.

Then, if the hold detectors 557 detect the sheet P (Step S3, Yes), the hardware processor 400 switches the blow direction of the front end air blower 52 to the upward blow to start blowing the separating air while it controls the side end air blowers 53, 54 to stop the blow (Step S4, (t2) in FIG. 10A and FIG. 10B). As a result, the separating air is blown to an end of the raised sheet P. This improves the puffing, and the sheet P is completely separated from the next sheet P1.

Then, the hardware processor 400 activates the sender 55 to send the topmost sheet P in the sheet feeding direction a (Step S5, (t3) in FIG. 10A and FIG. 10B).

When the rear end the topmost sheet P is detached from the rear end holder 57 as the sender 55 sends it, the second opening 571*b* becomes open. Then, the negative pressure in the second duct 572 is decreased, and the movable portion 571 starts to move down by its own weight (Step S6, (t4) in FIG. 10B).

When the movable portion 571 moves down and eventually holds the rear end of the next sheet P1 on the second holding area C, the movable portion 571 starts to move up again since the negative pressure in the second duct 572 is increased (Step S7, (t5) in FIG. 10B). As a result, the rear end of the next sheet P1 is pulled up and separated from the sheet thereunder.

Subsequently, the hardware processor 400 switches the blow direction of the front end air blower 52 to the downward blow and controls the front end air blower 52 and the side end air blowers 53, 54 to blow the raising air (Step S8, (t6) in FIG. 10A and FIG. 10B). As a result, the front end of the next sheet P1 is raised and held on the first holding area B of the belts 556.

The hardware processor 400 makes a determination as to whether the status of the hold detector 557 is "OFF", which represents the rear end of the sheet P having been passed through the sender (Step S9). If it is determined that the status is not "OFF" (Step S9, No), the hardware processor 400 repeats the determination in Step S9.

If it is determined that the status of the hold detector 557 is "OFF" (Step S9, Yes), the hardware processor 400 stops the sender 55 (Step S10, (t7) in FIG. 10A and FIG. 10B).

Subsequently, the hardware processor 400 makes a determination as to whether the topmost sheet P is the last page of the current sheet feeding process (Step S11). If it is determined that the topmost sheet P is not the last page (Step S11, No), the control returns to Step S2 to continue feeding the next sheet P1. If it is determined that the topmost sheet P is the last page (Step S11, Yes), the sheet feeding control ends.

Technical Effects of Embodiment

The sheet feeder 500 of the image forming apparatus 100 according to the embodiment can improve the productivity.

This will be described with the timing charts in FIG. 10A and FIG. 10B. After the rear end of the topmost sheet P0 is detached from the rear end holder 57, the rear end holder 57 holds and fixes the rear end of the next sheet P1. This allows reducing the period ((T1) in FIG. 10A and FIG. 10B) from the point ((t3) in FIG. 10A and FIG. 10B) of starting conveyance of the topmost sheet P0 until the point ((t6) in FIG. 10A and FIG. 10B) of raising the next sheet P1.

Further, since the next sheet P1 is fixed while the rear end holder 57 holds the rear end thereof, it is possible to shift the point ((t6) in FIG. 10A and FIG. 10B) of starting blow of the raising air to the next sheet P1 to an earlier timing at which the sender 55 is still sending the topmost sheet P0, and it is possible to start blowing the separating air at the point ((t7) in FIG. 10A and FIG. 10B) at which the topmost sheet P0 has passed through the sender 55. This is also applicable to the subsequent sheets P. In this regard, it is possible to start conveyance of the next sheet P at an earlier timing by setting the period ((T3) in FIG. 10A and FIG. 10B) to the same length as in the prior art. The period T3 is from the point ((t7) in FIG. 10A and FIG. 10B) of switching the blow direction of the front end air blower 52 to the upward blow to blow the separating air so as to start puffing the sheet P to the point ((t8) in FIG. 10A and FIG. 10B) of starting conveyance of the next sheet P1. That is, starting conveyance of the sheet P at an earlier timing can reduce the waiting time and thereby improve the productivity.

In the sheet feeder 500 of the embodiment, the hardware processor 400 changes the timing of blowing the raising air from the front end air blower 52 and the side end air blowers 53, 54, which is performed after the rear end holder 57 holds the rear end of the sheet P, based on at least one of the paper type, the length in the sheet feeding direction, the basis weight and the environment of the loaded sheets P. The timing of the blow is delayed in a less-separable condition so that the rear end holder 57 holds the sheet P for a longer time. That is, the length of time the rear end holder 57 holds the sheet P is changed according to the ease of separating the sheets P. This can improve the separation.

In the sheet feeder 500 of the embodiment, the hardware processor 400 maintains the blow direction of the front end air blower 52 in the downward blow to blow the raising air so as to raise the front end of the sheet from the other loaded sheets thereunder for a predetermined time after the start of the blow. Thereafter, the hardware processor 400 switches the blow direction to the upward blow to blow the separating air so as to separate the raised sheet from the other sheets thereunder. That is, the sheet feeder 500 firstly blows the raising air to raise a sheet and then switches the blow direction to blow the separating air toward the rear end. This can reduce the time required to separate the sheet P and improve the efficiency.

In the sheet feeder 500 of the embodiment, the hardware processor 400 controls the on/off and the strength of the blow of the raising air from the front end air blower 52 and the side end air blowers 53, 54 and the on/off and the strength of the blow of the separating air from the front end air blower 52 based on at least one of the paper type, the length in the sheet feeding direction, the basis weight and the environment of the loaded sheets. This can improve the separation according to the conditions.

In the sheet feeder 500 of the embodiment, the hardware processor 400 serves as a hold controller. At the start of the sheet feeding process, sheet feeder 500 controls the rear end holder 52 to start holding the topmost sheet P0 after starting blow of the raising air before the sheet P0 reaches the front end holder. That is, the rear end of the sheet P0 is pulled up before the front end is completely raised. This can reduce the waiting time and thereby improve the production efficiency.

Others

In addition to the above-described configuration, the on/off and the strength of the separating air may be determined based on at least one of the paper type, the length in the sheet feeding direction, the basis weight and the environment of the sheets. When the sheets are long, the strength of the separating air may be increased so that the separating air can reach the rear end to puff the sheets better. When the sheets are short in the conveyance direction, the strength of the separating air may be decreased, or the separating air may not be blown so that the damage on the sheets can be reduced.

In the above-described embodiment, the blow direction of the front end air blower 52 is switched between the upward blow and the downward blow based on the sheet feeding state. However, depending on the sheet type or the like, the blow direction may remain in either upward or downward blow. For example, when the sheets are curled in a downward concave shape, the upward blow may press the second sheet against the topmost sheet, which produces an opposite effect to the puffing. In such cases, it is effective to always keep the blow direction in the downward blow, and the puffing is achieved only by the rear end holder 57 that pulls up the rear end.

In the above-described embodiment, whether to hold the rear end of a sheet and the holding force of the rear end holder 57 may be controlled based on the paper type, the basis weight, the size and the environment of the sheets and the like. That is, the suction force may be increased in a less-separable condition. This can improve the separation. In contrast, when the sheets to be fed are thin sheets that are easy to raise but is readily winkled, the suction force may be decreased or the rear end holder 57 may not hold a sheet. This can reduce damage on the sheets. To change the suction force, the hardware processor 400 may serve as a hold controller to change the rotation speed of the second fan 573 so as to change the negative pressure in the second duct 572.

In the above-described embodiment, the movable portion 571 moves up by negative pressure. However, the mechanism is not limited thereto, and the movable portion 571 may move up by an actuator such as a solenoid.

In the above-described embodiment, the movable portion 571 moves down by its own weight. However, the mechanism is not limited thereto, and the movable portion may move down by a biasing member such as a spring.

In the above-described embodiment, negative pressure is utilized to create the suction force. However, mechanism is not limited thereto, and static electricity may also be utilized. Further, any other mechanisms that can hold a sheet on the movable portion 571 may be utilized.

Second Embodiment

Hereinafter, a second embodiment of the present invention will be described with the drawings. While a variety of limitations that are favorable for carrying out the present invention are included in the following second embodiment, the scope of the present invention is not limited to the following embodiment and illustrated examples.

The same reference signs are denoted to the same components as those of the first embodiment, and the detailed description is omitted.

Figure 9:
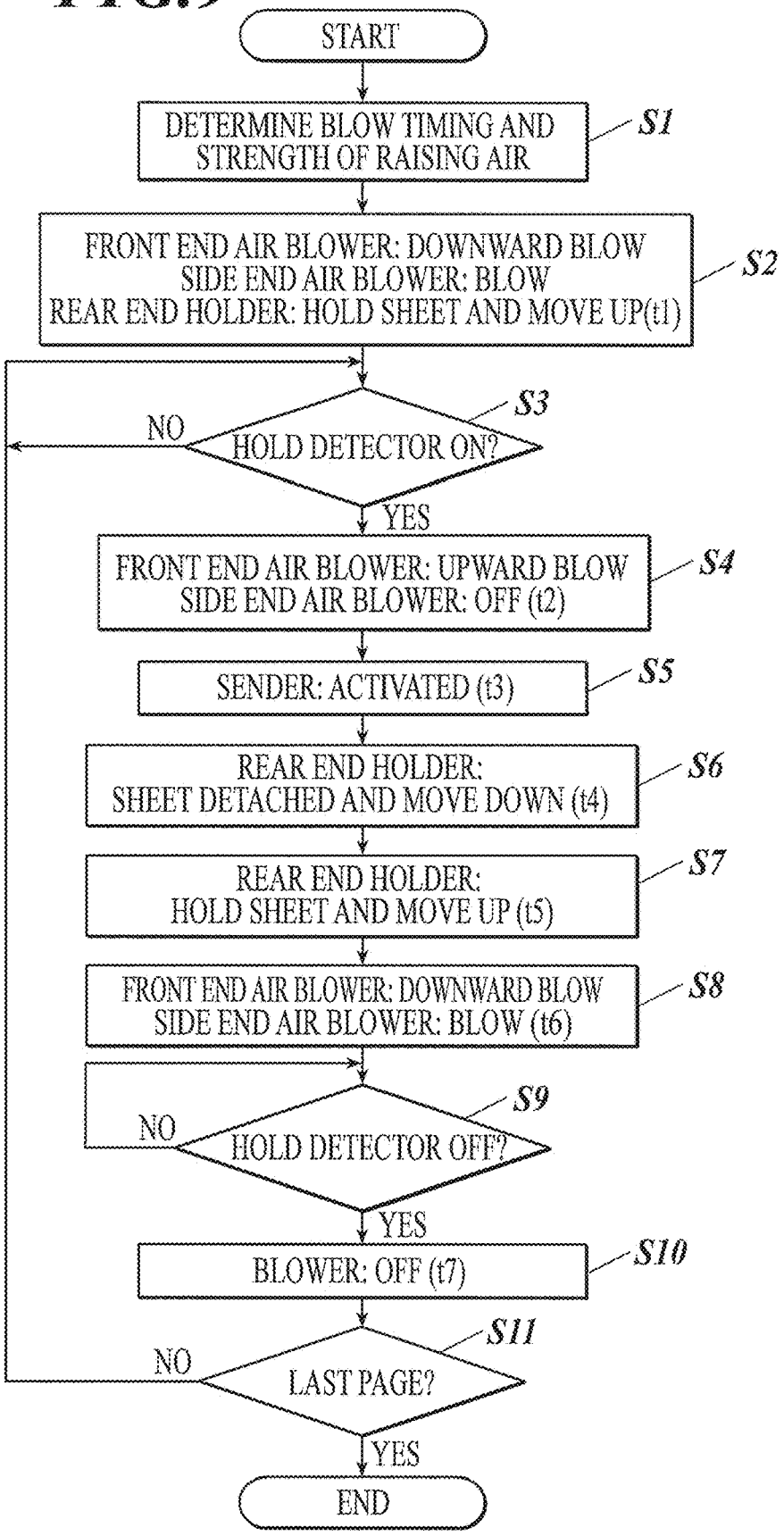
FIG. 9 is a flowchart of an operation control in successive feed.
Figure 10A:
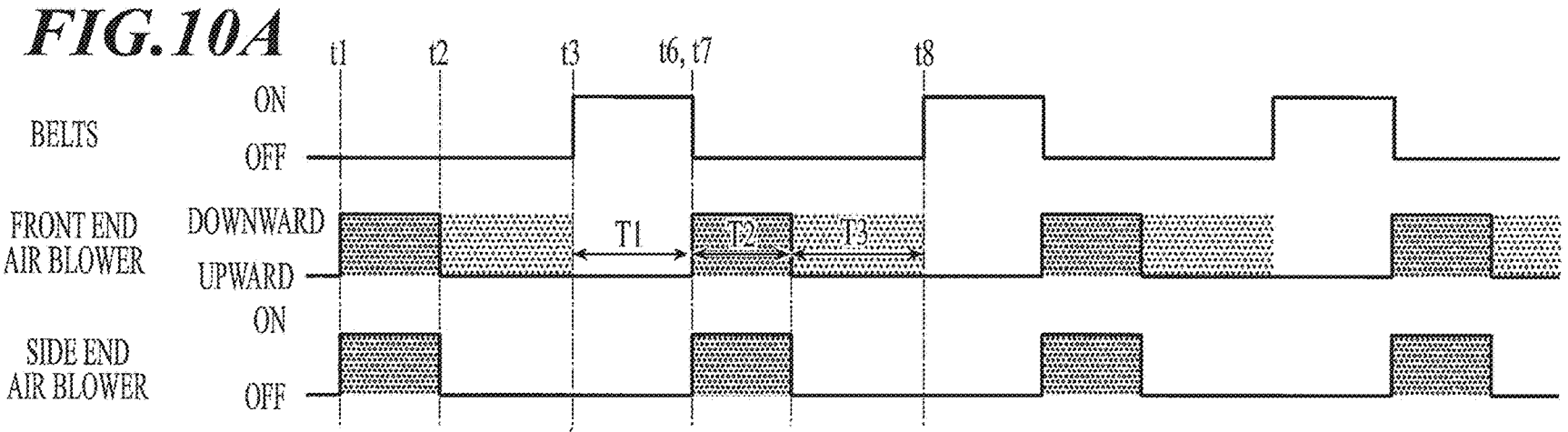
FIG. 10A and FIG. 10B are a timing chart of the operation control in successive feed.
Figure 10B:
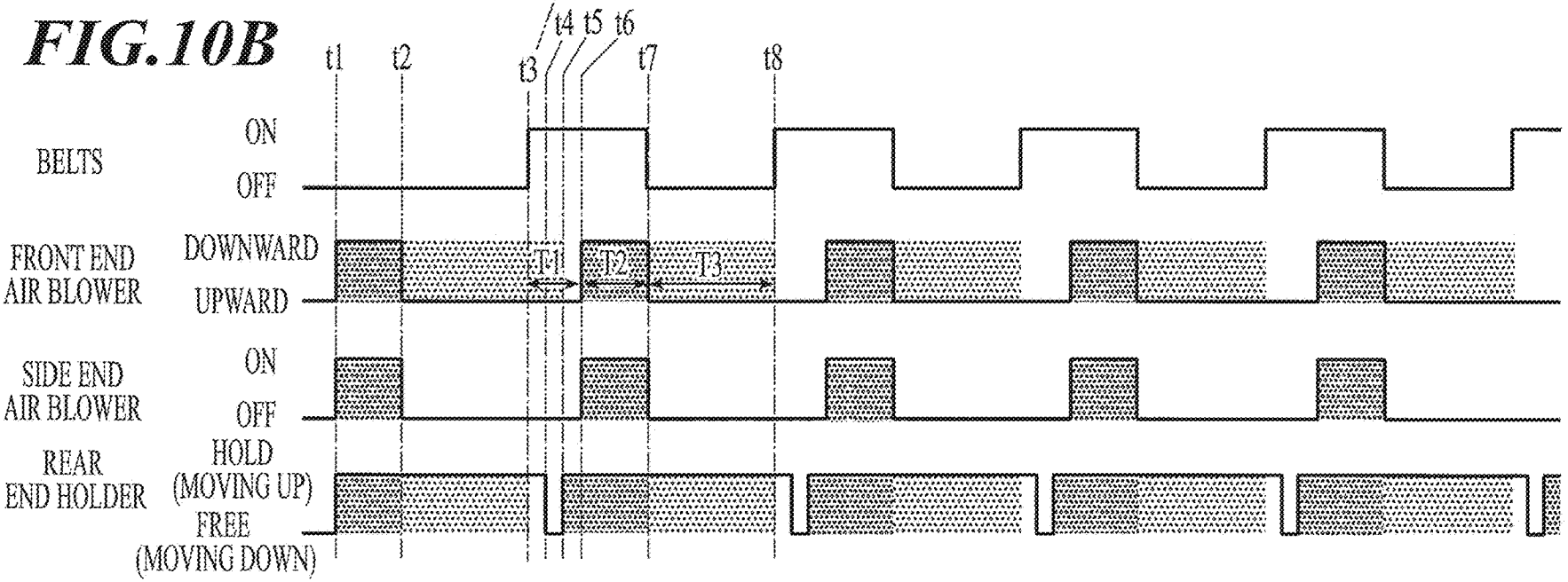

Flow of Operation Control of Successive Sheet Feeding in Sheet Feeding Apparatus In the second embodiment, the flow of the operation control of successive sheet feeding in the sheet feeding apparatus is identical to that of the first embodiment as illustrated in the flowchart of FIG. 9. However, conveyance of the next sheet P1 is started at the same timing as that in the prior art so as to improve the puffing.

Technical Effects of Embodiment

A sheet feeder 500 of an image forming apparatus 100 of the embodiment can puff up sheets P more effectively.

This will be described with the timing chart in FIG. 11A through FIG. 11B. After the rear end of the topmost sheet P0 is detached from the rear end holder 57, the rear end holder 57 holds the rear end of the next sheet P1 to fix it. This allows reducing the period ((T1) in FIG. 11A and FIG. 11B) from the point ((t3) in FIG. 11A and FIG. 11B) of starting conveyance of the topmost sheet P0 until the point ((t6) in FIG. 11A and FIG. 11B) of raising the next sheet P1.

Figures 11A, 11B:
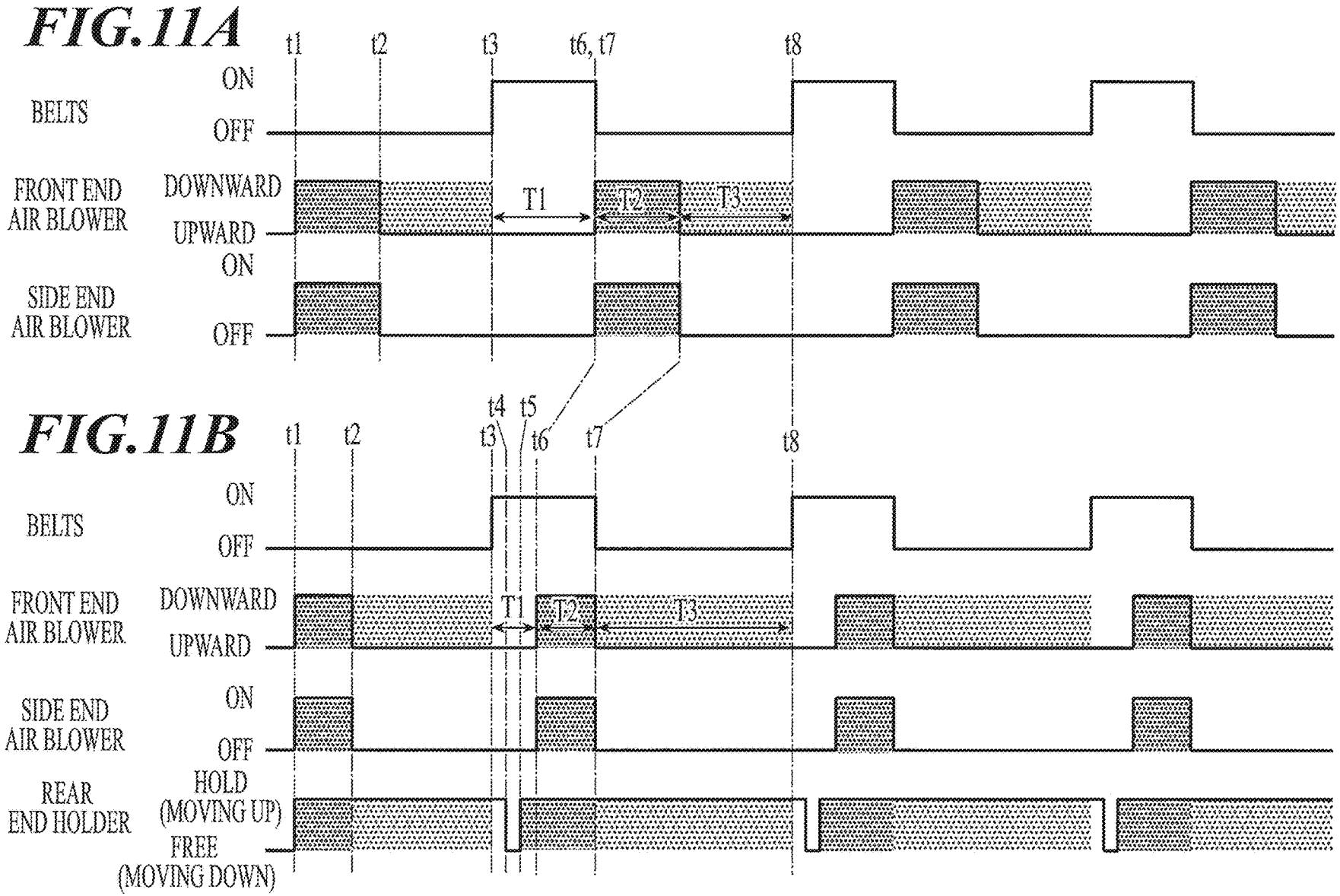
FIG. 11A and FIG. 11B are a timing chart of the operation control in successive feed.

Further, since the next sheet P1 is fixed while a rear end holder 57 holds the rear end thereof, it is possible to shift the point ((t6) in FIG. 11A and FIG. 11B) of starting blow of the raising air to the next sheet P1 to an earlier timing while a sender 55 is sending the topmost sheet P0, and it is possible to start blowing the separating air from the point ((t7) in FIG. 11A and FIG. 11B) at which the topmost sheet P0 has passed through the sender 55. This is also applicable to the subsequent sheets P.

In this regard, it is possible to extend the period ((T3) in FIG. 11A and FIG. 11B) of puffing up the sheet P relative to the period ((T2) in FIG. 11A and FIG. 11B) of raising the next sheet P1 by setting the period (total period of (T1), (T2) and (T3) in FIG. 11A and FIG. 11B) from the point ((t3) in FIG. 11A and FIG. 11B) of starting conveyance of the topmost sheet P0 until the point ((t8) in FIG. 11A and FIG. 11B) of starting conveyance of the next sheet P1 to the same length as in the prior art. In the present invention, this can reduce the friction between the loaded sheets and separate them completely so as to reduce the occurrence of double feeding.

In the sheet feeder 500 of the embodiment, the movable portion 571 moves down by its own weight after the sheet P is detached from the rear end holder 57. Since the movable portion 571 does not require a dedicated mechanism for the downward movement, the effects of the present invention can be obtained with the simple configuration.

In the sheet feeder 500 of the embodiment, when the movable portion 571 holds a sheet P, it moves up by the negative pressure that is generated by the second fan 573. Since the movable portion 571 does not require a dedicated mechanism for the upward movement, the effects of the present invention can be obtained with the simple configuration.

In the sheet feeder 500 of the embodiment, the movable portion 571 has a second opening 571*b* at the portion that contacts with a sheet P. A hardware processor 400 controls the negative pressure such that when the movable portion 571 holds a sheet P, the force by the negative pressure is greater than the weight of the movable portion 571, and when the movable portion 571 does not hold a sheet P, the force by the negative pressure is less than the weight of the movable portion 571. This allows suitably controlling the upward and downward movement of the movable portion 571.

The sheet feeder 500 of the embodiment includes a rear end regulating member 512 that regulates the position of the rear end in the sheet feeding direction of the loaded sheets, and the rear end holder 57 is disposed integrally with the rear end regulating member 512. Therefore, the rear end holder 57 does not require a large space.

In the sheet feeder 500 of the embodiment, the rear end regulating member 512 is movable in the sheet feeding direction a of the sheets P, and the rear end holder 57 moves along with the rear end regulating member 512 according to the length in the sheet feeding direction a of the loaded sheets P. This allows reliably holding the rear end of a sheet P regardless of the size of the sheet P.

Others

In addition to the above-described configuration, the strength of separating air and raising air may be changed according to the paper type, the basis weight and the size of the sheets and the like. That is, to feed sheets which are difficult to raise, such as board paper, the strength of the separating air and the raising air may be increased to increase the raising effect. In contrast, to feed thin sheets which are easy to raise but readily curled, the strength of the separating air and raising air may be decreased to reduce damage on the sheets.

In the above-described embodiment, the separating air is switched between the upward blow and the downward blow according to the sheet feeding state. However, depending on the paper type or the like, the blow direction may be always kept in either upward blow or downward blow. For example, when the sheets are curled in a downward concave shape, the upward blow of the separating air may press the second sheet against the topmost sheet, which produces an opposite effect to puffing. In such cases, it is effective to always keep the blow direction of the separating air in the downward blow, and the puffing is achieved only by the rear end holder 57 that pulls up the rear end.

In the above-described embodiment, the strength and the negative pressure of the second fan 573 may be changed according to the paper type, the basis weight, the size and the environment of the sheets and the like. That is, for example, to feed board paper that is difficult to raise, the negative pressure may be increased to enhance the raising assist at the rear end. In contrast, to feed thin sheets that are easy to raise but readily curled, the negative pressure may be decreased to reduce the damage on the sheets that is caused when the rear ends are held.

In the above-described embodiment, the highest position of the movable portion 571 where it stops upward movement is defined by a pin 571*a* and a window hole 572*a*, and the pin 571*a* abuts an end of the window hole 572*a* at the highest position. However, the mechanism is not limited thereto. The window hole 572*a* may be configured to be able to change the height position of the pin 571*a* so that the movable range in the height direction of the movable portion 571 is selectable from several ranges. This allows setting the highest position according to the sheet conditions. For example, when the sheets are long in the sheet feeding direction and the friction between the sheets are high, the highest position may be set at a higher level so that the topmost sheet is separated from the other sheets thereunder as far as possible.

Alternatively, the highest position of the movable portion 571 may be set according to the sheet conditions by selecting the movement in the height direction of the rear end regulating member 512 from several ranges.

Variation

Hereinafter, a variation of the rear end holder 57 will be described.

Figure 12:
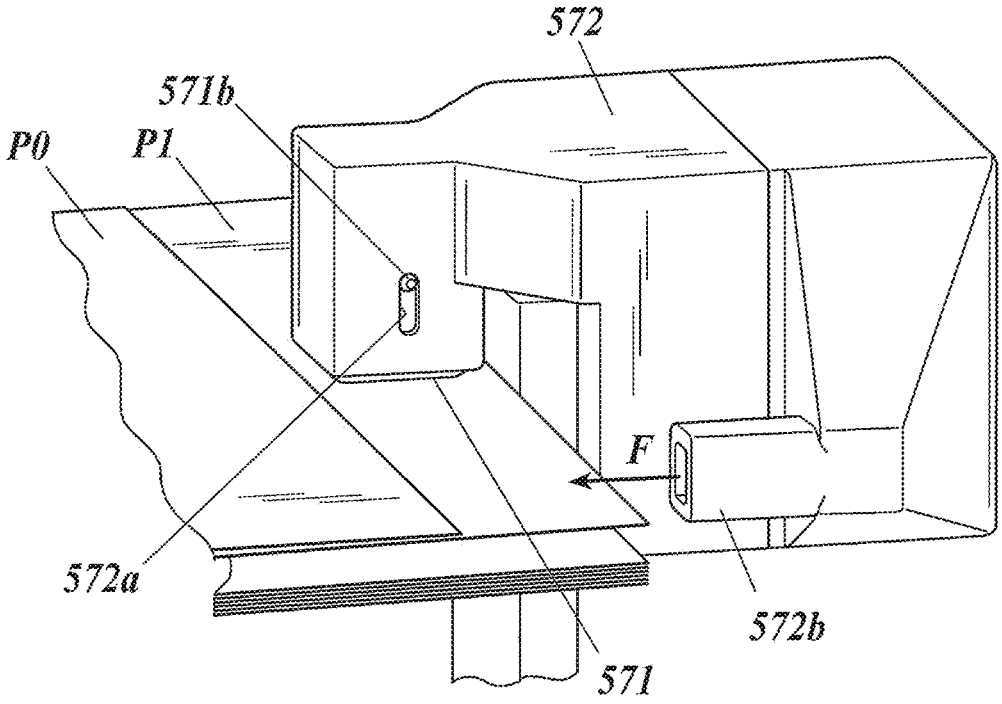
FIG. 12 illustrates a variation of the rear end holder according to the present invention.

As illustrated in FIG. 12, the rear end holder 57 of the variation has an outlet opening 572*b* at the second duct 572 opposed to the rear end of the loaded sheets P. The outlet opening 572*b* serves as a blower that blows air from the second fan 573 to the rear end of the loaded sheets in the direction of the arrow F in the figure. That is, air is blown through the outlet opening 573*b* while the rear end of a sheet P is pulled up by the movable portion 571. This can enhance the puffing effect.

Other Embodiments

In the foregoing, the present invention is specifically described with some embodiments. However, the above-described embodiments are merely preferred examples of the present invention, and the present invention is not limited thereto.

For example, the above-described embodiments are examples of color image forming apparatuses that transfer an image on the photoreceptor drum to the intermediate transfer roller by primary transfer and further transfers the image on the intermediate transfer roller to a sheet by using the secondary transfer roller. However, the present invention is also applicable to black and white image forming apparatuses that directly transfer an image from a photoreceptor drum to a sheet by using a transfer roller.

The above-described embodiments are examples of electrophotographic image forming apparatuses. However, the sheet feeding apparatus of the present invention is also applicable to inkjet image forming apparatuses.

The first embodiment is an example of the sheet feeding apparatus that holds and conveys sheets by using air. However, the present invention is also applicable to sheet feeding apparatuses that separate sheets by the friction of a sheet feeding roller.

In the above description, non-volatile memories, hard disks and the like are illustrated as examples of computer-readable media storing a program according to the present invention. However, the computer-readable medium is not limited thereto. Other computer-readable media that are applicable include portable recording media such as CD-ROM. Carrier wave is also applicable as a medium for distributing data of the program according to the present invention through a communication line.

Suitable changes can be made in the detailed configurations and operations of the components of the image forming apparatuses without departing from the features of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet feeding apparatus, comprising:

a sheet loader which stores stacked sheets;

a rear end holder which holds a rear end in a sheet feeding direction of a topmost sheet on the sheet loader;

an air blower which blows air to the loaded sheets to raise a sheet;

a front end holder which holds a front end of the raised topmost sheet;

a sender which sends the sheet in the sheet feeding direction; and an air controller which controls blow of the air from the air blower, wherein the air controller controls the air blower to start blowing a raising air to raise the sheet after the rear end holder holds the rear end of a next sheet that is stacked under the topmost sheet before a rear end of the topmost sheet sent in the sheet feeding direction by the sender passes through the front end holder.

2. The sheet feeding apparatus according to claim 1, wherein the air controller changes a blow timing of the raising air of the air blower based on at least one of a paper type, a length in the sheet feeding direction, a basis weight and an environment of the loaded sheets.

3. The sheet feeding apparatus according to claim 2, wherein the air controller delays the blow timing of the raising air as the sheets are less separable.

4. The sheet feeding apparatus according to claim 1, wherein the air controller sets a blow direction of the air blower to a first blow direction to blow the raising air for a predetermined period from a start of blowing air so as to raise the sheet from other sheets stacked under the sheet and thereafter switches the blow direction to a second blow direction to blow a separating air so as to separate the raised topmost sheet from a next sheet under the topmost sheet.

5. The sheet feeding apparatus according to claim 4, wherein the air controller controls whether to blow the separating air and a blow strength of the separating air or the raising air from the air blower based on at least one of a paper type, a length in the sheet feeding direction, a basis weight and an environment of the loaded sheets.

6. The sheet feeding apparatus according to claim 1, further comprising:

a hold controller which controls hold of the rear end of the sheet by the rear end holder, wherein the hold controller controls whether to hold the rear end by the rear end holder and a holding force of the rear end holder based on at least one of a paper type, a length in the sheet feeding direction, a basis weight and an environment of the loaded sheets.

7. An image forming apparatus, comprising:

a sheet feeding apparatus according to claim 1; and an image formation unit which forms an image on a sheet fed from the sheet feeding apparatus.

8. A sheet feeding apparatus, comprising:

a sheet loader which stores stacked sheets;

a rear end holder which holds a rear end in a sheet feeding direction of a topmost sheet on the sheet loader;

an air blower which blows air to the loaded sheets to raise a sheet;

a front end holder which holds a front end of the raised topmost sheet;

a sender which sends the sheet in the sheet feeding direction; and a hold controller which controls hold of the rear end of the sheet by the rear end holder, wherein at a start of a sheet feeding process, the hold controller controls the rear end holder to start holding the sheet after the air blower blows the air before the topmost first sheet reaches the front end holder.

9. An image forming apparatus, comprising:

a sheet feeding apparatus according to claim 8; and an image formation unit which forms an image on a sheet fed from the sheet feeding apparatus.

10. A sheet feeding apparatus, comprising:

a sheet loader which stores stacked sheets;

a rear end holder which holds a rear end in a sheet feeding direction of a topmost sheet on the sheet loader; and a sender which sends the sheet in the sheet feeding direction, wherein the rear end holder comprises:

a movable portion which moves in upward and downward directions that are perpendicular to a sheet surface of the sheets loaded on the sheet loader; and a holding force generator which generates a holding force for holding the sheet on the movable portion, and wherein when no sheet is held on the movable portion, the movable portion moves downward to come in contact with the topmost sheet on the sheet loader, and when the movable portion holds the sheet, the movable portion moves up to separate the rear end of the sheet from other sheets.

11. The sheet feeding apparatus according to claim 10, wherein the movable portion moves down by an own weight of the movable portion.

12. The sheet feeding apparatus according to claim 10, wherein the suction force generator comprises a negative pressure generator which generates a negative pressure between the movable portion and the sheet so as to hold the sheet, and wherein the movable portion moves up by the negative pressure generated between the movable portion and the sheet by the negative pressure generator.

13. The sheet feeding apparatus according to claim 12, wherein the movable portion comprises a suction hole at a portion which contacts with the sheet, and wherein when the suction hole is closed, a force by the negative pressure generated by the negative pressure generator is greater than a force by an own weight of the movable portion, and when the suction hole is open, the force by the negative pressure generated by the negative pressure generator is less than the force by the own weight of the movable portion.

14. The sheet feeding apparatus according to claim 12, further comprising: a blower which blows air to the rear end of the loaded sheets, in which the air is discharged from the negative pressure generator when the negative pressure generator generates the negative pressure.

15. The sheet feeding apparatus according to claim 12, further comprising:

a negative pressure controller which controls generation of the negative pressure by the negative pressure generator, wherein the negative pressure controller controls whether to generate the negative pressure by the negative pressure generator and an intensity of the negative pressure based on at least one of a paper type, a length in the sheet feeding direction, a basis weight and an environment of the loaded sheets.

16. The sheet feeding apparatus according to claim 10, wherein a moving distance in upward and downward directions of the movable portion is changed based on at least one of a paper type, a length in the sheet feeding direction, a basis weight and an environment of the loaded sheets.

17. The sheet feeding apparatus according to claim 10, further comprising:

a rear end position regulator which regulates a position of the rear end in the sheet feeding direction of the loaded sheets, wherein the rear end holder is provided at the rear end position regulator.

18. The sheet feeding apparatus according to claim 17, wherein the rear end position regulator moves in the sheet feeding direction of the sheet, and wherein the rear end holder moves along with the rear end position regulator according to a length in the sheet feeding direction of the loaded sheets.

19. An image forming apparatus, comprising:

the sheet feeding apparatus according to claim 10; and an image formation unit which forms an image on the sheet fed by the sheet feeding apparatus.

* * * * *